US007797832B2

(12) United States Patent
Kamiya

(10) Patent No.: US 7,797,832 B2
(45) Date of Patent: Sep. 21, 2010

(54) CAST ALUMINUM WHEEL MANUFACTURING AND PRODUCTS

(75) Inventor: Shunkichi Kamiya, Nagoya (JP)

(73) Assignee: Kosei Aluminum Co., Ltd., Tokyo (JP)

( * ) Notice: Subject to any disclaimer, the term of this patent is extended or adjusted under 35 U.S.C. 154(b) by 1026 days.

(21) Appl. No.: 11/537,629

(22) Filed: Sep. 30, 2006

(65) Prior Publication Data

US 2008/0086886 A1 Apr. 17, 2008

(51) Int. Cl.

| | |
|---|---|
| ***B21B 1/46*** | (2006.01) |
| ***B21D 53/26*** | (2006.01) |
| ***B22D 7/10*** | (2006.01) |
| ***B22D 27/04*** | (2006.01) |
| ***B22D 29/00*** | (2006.01) |
| ***B22D 45/00*** | (2006.01) |
| ***B60B 1/06*** | (2006.01) |
| ***B60B 19/00*** | (2006.01) |

(52) U.S. Cl. ..... 29/894.3; 29/894; 29/527.6; 29/527.5; 164/69.1; 164/122; 164/126; 164/128; 164/272; 164/348; 301/5.1; 301/65

(58) Field of Classification Search ..... 29/894, 29/894.3, 527.5, 527.6; 164/69.1, 122, 126, 164/128, 272, 348

See application file for complete search history.

(56) References Cited

U.S. PATENT DOCUMENTS

| | | | | |
|---|---|---|---|---|
| 5,022,797 | A | 6/1991 | Sawa et al. | |
| 5,078,551 | A | 1/1992 | Oomen | |
| 5,647,426 | A * | 7/1997 | Prieto et al. | 164/348 |
| 2001/0005939 | A1 * | 7/2001 | Pollkoetter | 29/894.35 |
| 2004/0139610 | A1 * | 7/2004 | Suzuki et al. | 29/894.3 |

FOREIGN PATENT DOCUMENTS

| | | |
|---|---|---|
| WO | WO 01/32339 A1 | 5/2001 |

OTHER PUBLICATIONS

Kosei Company Profile—Working in Harmony with the Environment—circa, 2003.
Kosei—2005 All Products Line.

* cited by examiner

*Primary Examiner*—David P Bryant
*Assistant Examiner*—Alexander P Taousakis
(74) *Attorney, Agent, or Firm*—Cook Alex Ltd.

(57) ABSTRACT

A process is provided for manufacturing aluminum vehicle wheels by a casting process that is followed by processing including flow forming and heat treatment steps while one or more risers remain on the cast wheel blank. The process can include directing cooling fluid onto an exposed surface of the casting mold to enhance wheel strength. One-by-one transfer of wheel blanks can be practiced to avoid negative aspects of batch processing.

16 Claims, 11 Drawing Sheets

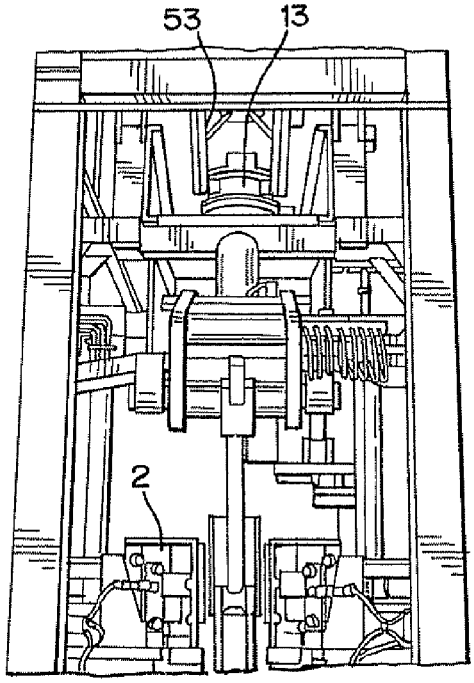
FIG.10
FIG. 11
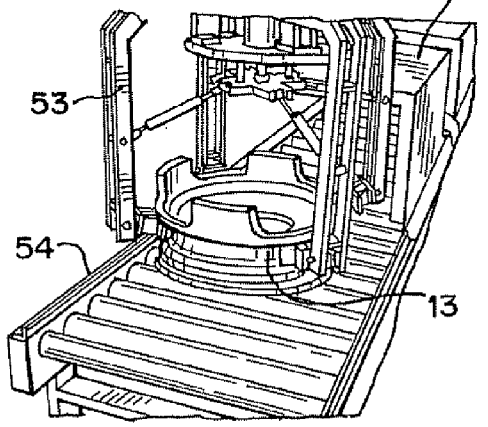
FIG. 12
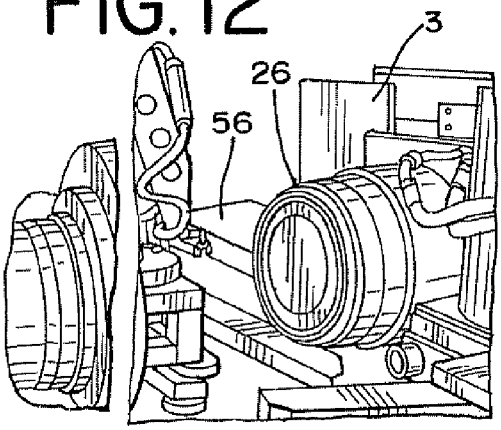
FIG. 13
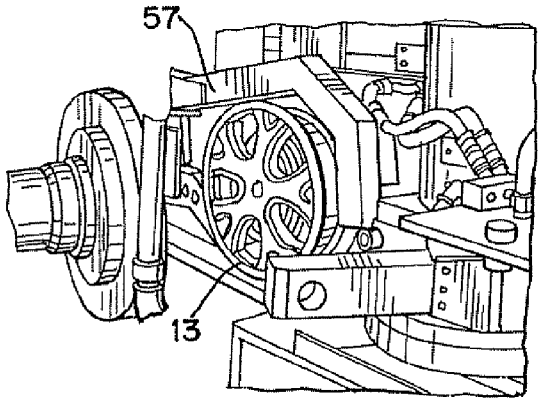
FIG. 14
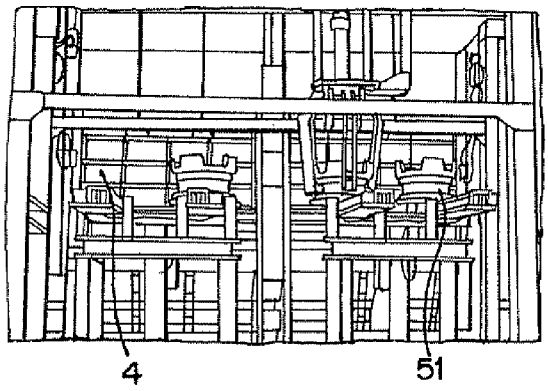
FIG. 15
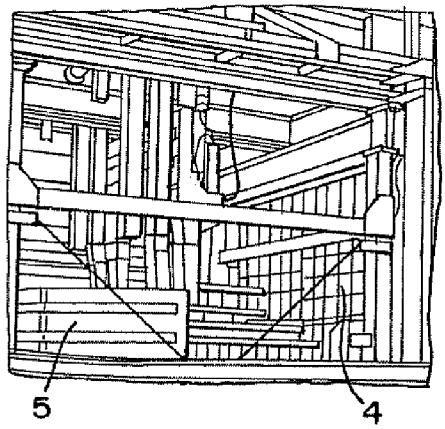

FIG.29

(unit:g/cm3)

| AS CAST WHEEL | N | | | | |
|---|---|---|---|---|---|
| INNER FLANGE | FIRST | SECOND | THIRD | FORTH | AVERAGE |
| B-1 | 2.6365 | 2.7404 | 2.7299 | 2.6569 | 2.6840 |
| B-2 | 2.6772 | 2.6098 | 2.6629 | 2.6691 | 2.6548 |
| B-3 | 2.6734 | 2.6259 | 2.6377 | 2.5930 | 2.6381 |
| B-4 | 2.6671 | 2.6546 | 2.6279 | 2.6429 | 2.6473 |
| B-5 | 2.6153 | 2.5986 | 2.6433 | 2.6416 | 2.6312 |
| B-6 | 2.5387 | 2.6325 | 2.6702 | 2.6191 | 2.6274 |
| | | | | AVERAGE | 2.6471 |

FIG.29a (unit:g/cm3)

| HSF | N | | | | |
|---|---|---|---|---|---|
| | FIRST | SECOND | THIRD | FORTH | AVERAGE |
| INNER FLANGE 1 | 2.6768 | 2.6661 | 2.6728 | 2.6626 | 2.6696 |
| INNER FLANGE 2 | 2.6788 | 2.6657 | 2.6660 | 2.6693 | 2.6700 |
| | | | | AVERAGE | 2.6698 |
| RIM-1 | 2.6766 | 2.6688 | 2.6720 | 2.6735 | 2.6727 |
| RIM-2 | 2.6775 | 2.6688 | 2.6694 | 2.6734 | 2.6723 |
| | | | | AVERAGE | 2.6725 |

FIG.30

| | REGION | TENSILE STRENGTH (MPa) | ELONGATION% | PROOF STRESS (MPa) |
|---|---|---|---|---|
| INNER FLANGE | GATE | 272 | 5.3 | 212 |
| | OPPOSITE OF GATE | 280 | 5.5 | 226 |
| | AVERAGE | 276 | 5.4 | 213 |
| RIM | GATE | 275 | 6.8 | 216 |
| | OPPOSITE OF GATE | 284 | 6.3 | 221 |
| | AVERAGE | 280 | 6.5 | 218 |

FIG. 30a

| HSF | REGION (HSF) | TENSILE STRENGTH (MPa) | ELONGATION% | PROOF STRESS (MPa) |
|---|---|---|---|---|
| INNER FLANGE | GATE | 299 | 9.5 | 223 |
| | OPPOSITE OF GATE | 304 | 9.8 | 234 |
| | AVERAGE | 302 | 9.7 | 229 |
| RIM | ROLLING DIRECTION IN GATE | 304 | 14.4 | 221 |
| | ROLLING DIRECTION IN OPPOSITE | 308 | 14.9 | 217 |
| | AVERAGE | 306 | 14.7 | 219 |

CAST ALUMINUM WHEEL MANUFACTURING AND PRODUCTS

BACKGROUND OF THE INVENTION

1. Field of the Invention

This invention generally relates to improving cast aluminum wheel production and improved cast aluminum vehicle wheels More particularly, the invention relates to process improvements that include shortening of cycle times, conserving resources and achieving energy saving effects, as well as modification of microstructures and mechanical properties of cast aluminum vehicle wheels.

2. Description of Related Art

Vehicle wheels made out of aluminum or aluminum alloys can be manufactured according to various methods. By one approach, the wheel is cast from molten aluminum material poured into a metal mold. By another approach, the wheel is forged from a billet of heated aluminum or aluminum alloy. By another approach, the wheel can be "spun" to a desired basic shape by the application of forging discs or rollers into a thin sheet of graded aluminum sheet. Such can be conducted in association with the introduction of pressures, either high or low, onto a molten alloy in the mold cavity. Flow-forming technology has improved on older "spinning" procedures. Additionally, aluminum vehicle wheels can be of a monoblock or multi-piece construction, depending upon the design requirements for the wheel being manufactured.

It can be considered that most aluminum vehicle wheel manufacturing techniques can be classified as either a casting approach or a forging approach. When compared with a forged wheel, a cast wheel has the advantages of facilitating design flexibility and lower cost. However, mechanical properties such as strength and favorable elongation characteristics are restricted by coarseness of the micro-grain structure of cast aluminum wheels and other metallurgical properties. Often, in order to achieve required strength, the rim portion of a cast wheel needs to be thicker than might be desired for design reasons, resulting in a wheel of relatively heavy weight, or at least of a weight that must be heavier than that needed to achieve certain desired design effects.

Heretofore, the coarse microstructure disadvantage of casting has been lessened by implementing a so-called spinning process The spinning process applies disc rollers to the cast wheel while it is in the plastic deformation stage in order to introduce high axial pressure onto the surface of the cast wheel. This spinning process has been found to improve the mechanical properties of the cast wheel. However, conventional cast wheel production temperature processes, even when flow forming is practiced in the conventional manner, are particularly wasteful of energy due to temperature changes needed for stabilizing microstructure and for refining grain size during various stages of the process, including cooling, heat treatment and quenching.

Energy inefficiencies can be realized during cast aluminum wheel manufacturing operations. Included is a conventional approach of conducting certain operations, including heating and transport, in a batch processing approach One might consider that this is an efficient approach in that multiple cast wheel blanks in close proximity to each other positively influence the temperature of each so as to maintain a desired temperature level. However, it has come to be appreciated in conjunction with the present invention that batch processing of this type can actually lead to inconsistencies in heat content and temperature gradients from wheel blank to wheel blank within a batch container such as a basket or tray.

In proceeding in accordance with the present invention, it has been determined that increased efficiencies in operation and energy conservation can be practiced during manufacturing of cast aluminum vehicle wheels while at the same time improving functional and strength characteristics of the resulting cast aluminum wheels. This facilitates achieving important design and strength objectives for cast aluminum vehicle wheels.

SUMMARY OF THE INVENTION

In an embodiment of the present invention, a process is provided for manufacturing cast aluminum wheels for vehicles. The process includes casting aluminum or aluminum alloy into an aluminum vehicle wheel blank having a riser extending from the body of the blank and processing the blank with the riser in place during multiple processing steps such as cooling, heating, heat treating and quenching. This provides for enhanced energy savings by reducing energy needed to achieve required temperature changes during flow-forming shaping and heat treatment of the raw wheel blank into a finished wheel blank. The riser is thereafter removed from the flow-formed and heat treated wheel blank.

In accordance with another embodiment of the present invention, a process is provided for manufacturing cast aluminum wheels for vehicles. This includes forming molten aluminum or aluminum alloy within a casting mold into a raw cast aluminum wheel blank. During this processing of the initially molded wheel blank, the front face of the wheel blank is cooled. According to another embodiment, cooling fluid is sprayed onto the external surface of mold walls in order to aid in processing effectiveness and efficiency of the casting operation The raw molded wheel blank is subsequently subjected to flow-forming procedures in order to shape the blank into a wheel having desired contour features In another embodiment, cast aluminum vehicle wheel blanks are manufactured and flow-formed to a wheel blank ready for machining of its face into a finished vehicle wheel. The processing line includes energy saving approaches that focus on a one-by-one handling of wheel blanks being processed, largely through the use of robotics and conveyor systems that avoid batch processing of several wheel blanks within one container or other confined location Insulated tunneling also may be included to reduce heat losses during production.

In accordance with another embodiment, cast aluminum vehicle wheel blanks are shaped with flow-forming equipment in connection with a robotic approach for inserting the raw blank into the flow-forming station wherein the robotic element directs a release coating onto the flow-forming mandrel prior to insertion of the raw blank onto the flow-forming mandrel, followed by robotic removal of the flow-formed blank from the flow-forming equipment.

In accordance with another embodiment of the present invention, cast aluminum vehicle wheels are provided that are thinner than conventional wheels yet as strong as, or stronger than, conventional wheels due to processing that provides the wheels with better uniformity of metallurgical structure and enhanced performance properties including higher density, tensile strength and elongation.

A general aspect or object of the present invention is to provide a process for manufacturing cast aluminum wheels for vehicles that includes a significant portion of the processing being conducted with one or more molding risers left in place during processing steps.

Another aspect or object of the present invention is to provide a manufacturing process for cast aluminum vehicle wheels that conserves energy and improves the wheels thus produced.

Another aspect or object of this invention is to provide a process for manufacturing cast aluminum vehicle wheels that significantly reduces the processing time between initial casting and having the wheel blank ready for final machining into a finished vehicle wheel.

Another aspect or object of the present invention is to provide an improved cast aluminum vehicle wheel that has a microstructure which is improved over the microstructure of wheels prepared by conventional flow-formed cast aluminum wheels, the wheels exhibiting enhanced density, tensile strength and elongation properties.

Other aspects, objects and advantages of the present invention will be understood from the following description according to the preferred embodiments of the present invention, specifically including stated and unstated combinations of the various features which are described herein, relevant information concerning which is shown in the accompanying drawings.

BRIEF DESCRIPTION OF THE DRAWINGS

FIG. 10 is a perspective illustration of a wheel casting taken from the mold by robotic action;

FIG. 11 is a perspective view showing automated placement of wheel castings onto conveyors having insulated coverings;

FIG. 12 is a perspective view illustrating mold lubricant spraying onto the mandrel surface prior to positioning thereon of a wheel from the cooling station illustrated in FIG. 4;

FIG. 13 is a perspective view of a cast aluminum wheel blank being mounted onto the lubricant-sprayed flow-forming mandrel;

FIG. 14 is an illustration of a one-by-one style of heat treatment furnace incorporated into an embodiment of the invention showing a casting being positioned at the front entrance of the furnace;

FIG. 15 is an illustration of the heat treatment furnace of FIG. 14, showing the exit location and also showing quench equipment;

FIG. 29 is a tabulation of cast wheel data for wheels made by prior art conventional casting;

FIG. 29*a* is a tabulation of cast wheel data for wheels made according to the invention;

FIG. 30 is a tabulation of tensile strength and elongation data for wheels made by prior art conventional casting;

FIG. 30*a* is a tabulation of tensile strength and elongation data for wheels made according to the invention;

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
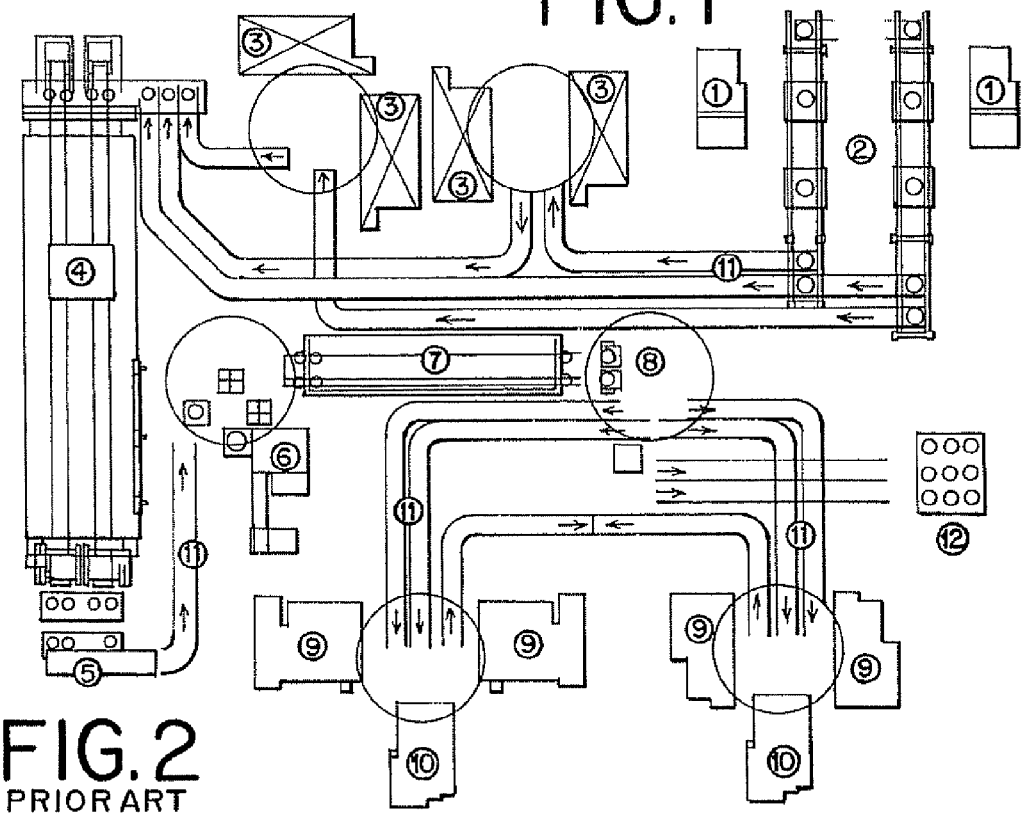
FIG. 1 is a schematic layout of an embodiment of a production line for manufacturing cast aluminum vehicle wheels that incorporates features described herein.

An overall schematic of a processing line incorporating features and embodiments of the invention is provided in FIG. 1. A plurality of melting furnaces 1 are illustrated, together with a plurality of casting machines 2 and flow forming machines 3. After flow forming, which is described in greater detail herein, formed wheel blanks are conveyed to a one-by-one type solution heat-treatment furnace 4, followed by quenching at quench station 5. A riser removal station 6 follows the quenching station. The illustrated embodiment includes a one-by-one type of aging furnace 7, with a water cooling tank 8 being illustrated at the end thereof. Wheel surface finishing, usually carried out on the front face of the wheel, is carried out at turning lathe stations 9 and machining centers 10. Movement among these various pieces of equipment and stations is conducted in part along a conveyor system 11. Wheels are shown at storage station 12.

Figure 2:
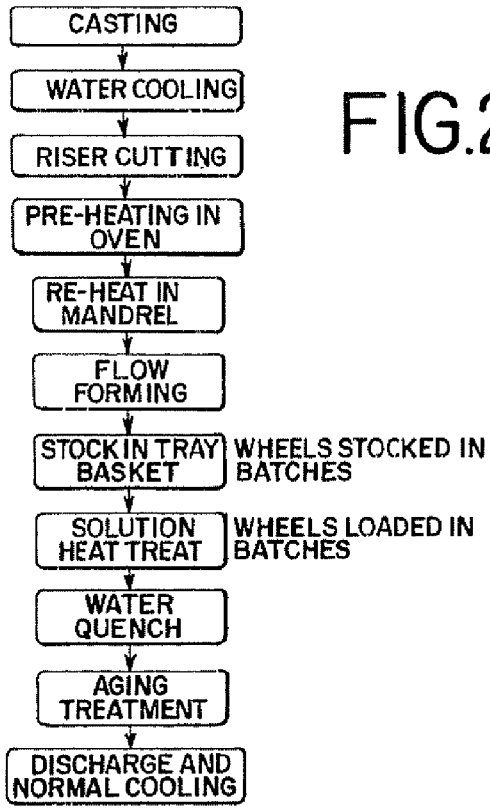
FIG. 2 PRIOR ART
FIG. 2 is a flowchart of a conventional prior art flow-forming line for manufacturing cast aluminum vehicle wheels.

FIG. 2 provides a flow chart of a prior art conventional line for manufacturing cast aluminum wheel blanks that includes flow-forming approaches of the prior art. Casting is followed by water cooling, after which each riser that is formed at a gate during the casting operation is removed from the initially cast and cooled part. Typically, there are multiple risers, and each is removed by cutting. In this conventional process, the raw wheel blanks from which risers have been removed are pre-heated in an oven and re-heated in the mandrel at which flow forming proceeds in accordance with approaches generally known in the art. The flow-formed banks are inserted into a tray or basket, these parts being stocked in batch fashion. Solution heat treatment then follows with the wheel parts loaded in batches within the furnace. This is followed by water quenching and aging. The wheels subjected to aging treatment then are discharged for normal cooling.

Figure 2A:
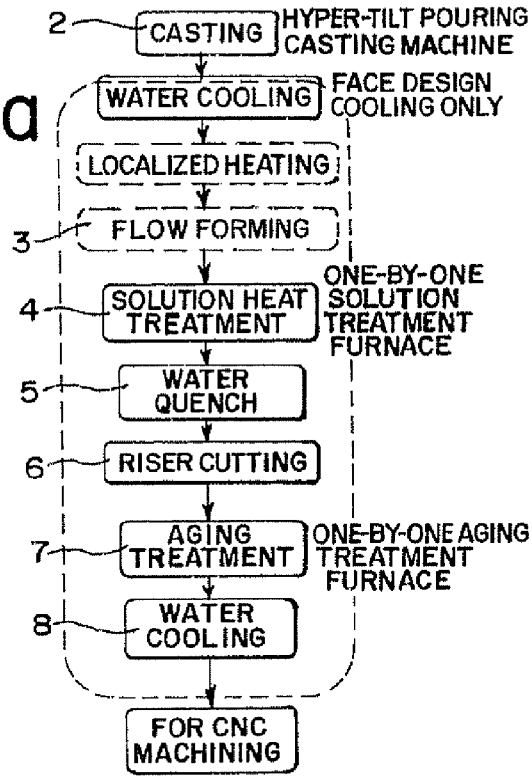
FIG. 2*a* is a flowchart of a production line in accordance with the present invention for manufacturing cast aluminum vehicle wheels.

The flow chart of FIG. 2*a* shows a casting line incorporating features and embodiments of the present invention. After casting, preferably in a casting machine that includes tilting to assure enhanced pouring and flow, the thus cast wheel comes out of the high-speed tilting pour casting machine with a surface temperature of about 400° C. to 450° C., possibly up to about 500° C., The initially cast parts are subjected to water cooling that cools substantially only the face portion of each part, and the parts are not fully immersed into a water bath or the like; for example, the rim portion is not immersed. Typically, this dipping takes about 10 to 15 seconds and reduces the temperature of the front portion of the raw wheel blank to below about 250° C. to about 350° C. This helps prevent deformation of the front face wheel design during flow-forming. This face-cooled wheel blank is inserted onto a mandrel and subjected to localized heating and flow forming as described in greater detail herein.

Each wheel then is subjected to one-by-one solution treatment in a furnace. This is followed by water quenching. Only after this stage is each riser removed from the wheel blank. This is followed by one-by-one aging treatment in an aging furnace and subsequent water cooling. The wheel blank then is ready for finishing, typically including the use of lathes and other machining equipment.

With further reference to the casting machines 2, they achieve the objectives of shortening solidification time within the casting mold and providing directional solidification conditions for enhancing wheel casting microstructure For example, conventional cycle times for aluminum wheel casting is approximately 240 seconds, whereas aluminum wheel casting as described herein typically is completed in about 180 seconds. In the illustrated embodiment of the equipment for carrying out the cast molding, temperature control is achieved through the use of thermocouples 31 that are fixed in specified positions of the mold in order to detect the accurate mold temperature at that location, as seen in FIG. 3

In a first step, an internal cooling process is carried out ("Direction 1" in FIG. 3*a*) for directional solidification in the spoke portion of the wheel blank being formed First, a cooling medium such as water, salt water, oil or the like is fed with pressure into pipe 32 in the lower mold 33 after the molten aluminum has been poured into the casting mold, typically with the assistance of a molten metal pouring robot unit. After this cooling has proceeded for several seconds, the cooling medium is fed into pipe 34 in the lower mold 33. These cooling procedures continue for from about ten seconds to about one minute This achieves internal cooling of the lower mold and thus of the molten aluminum thereat.

Figure 3:
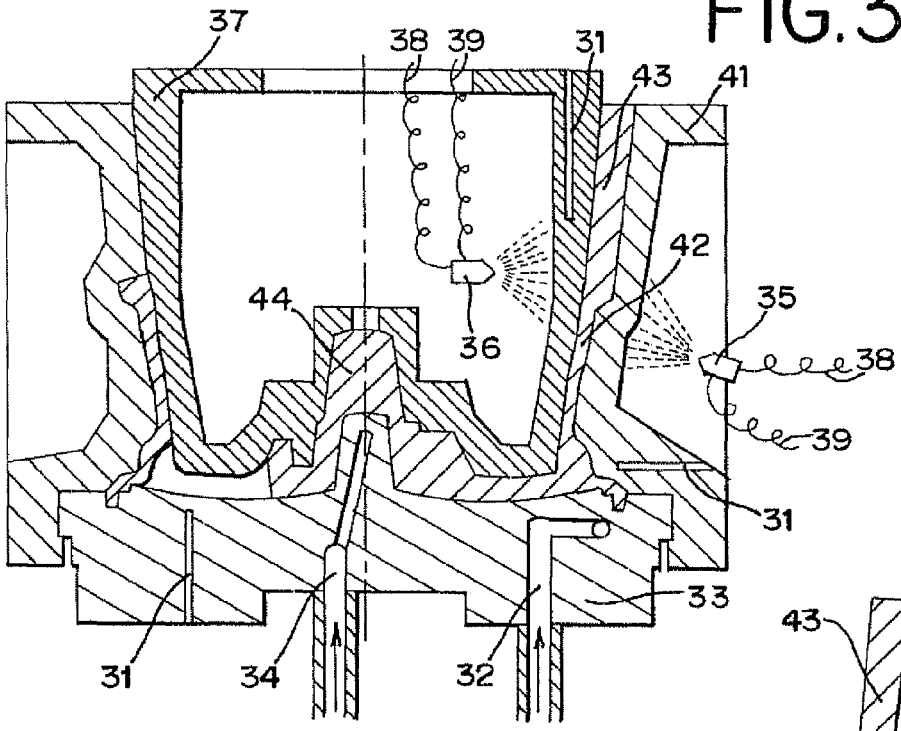
FIG. 3 is a schematic illustration in cross-section showing mold wall cooling and spraying in accordance with an embodiment of the invention.
Figure 3A:
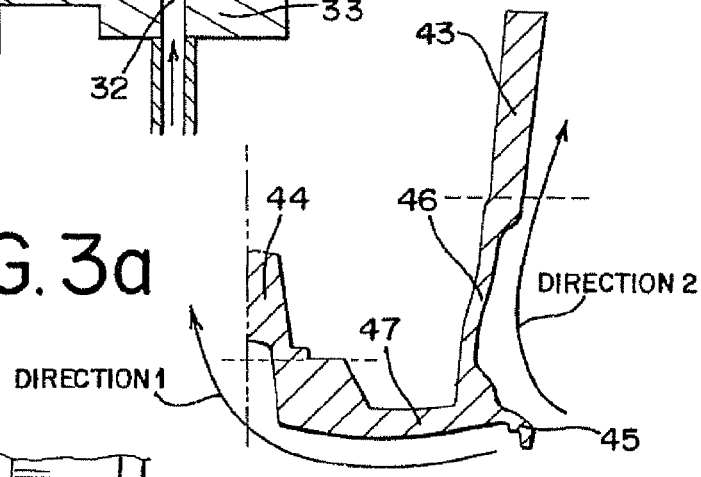
FIG. 3*a* is cross-sectional illustration of directional solidification of aluminum wheel castings.
Figure 4:
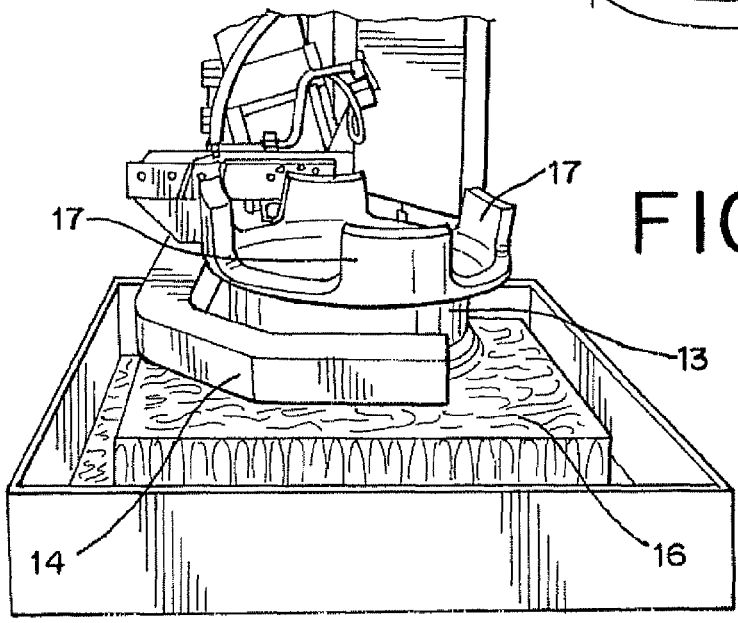
FIG. 4 is a perspective view of an embodiment of a processing station at which a wheel blank face is subjected to water cooling under the guidance of a robot arm.

FIG. 3*a* also shows "Direction 2" for directional solidification of the rim portion of the cast wheel material. After cooling through pipe 32 for several seconds, an external atomizing cooling process is initiated. This achieves localized cooling and includes applying a fluid mist onto the exposed surfaces of the side molds by an outside atomizing nozzle 35 and also typically by an inside atomizing nozzle 36. The spraying fluid typically is a mist combining a liquid and air, the liquid being water, salt water, oil or the like. Typically, this spraying continues until the casting molds are opened after suitable solidification.

FIG. 3 further illustrates an upper mold 37, an air hose 38 for each atomizing unit, and a liquid conduit 39 for each of the atomizing units. Side molds also are illustrated here. Contained within the mold is the wheel casting 42 which includes gate riser castings 43 and a central riser 44. In addition, FIG. 3*a* shows an outer flange 45 of the wheel casting, as well as rim casting portion 46 and spoke casting portion 47.

Figure 5:
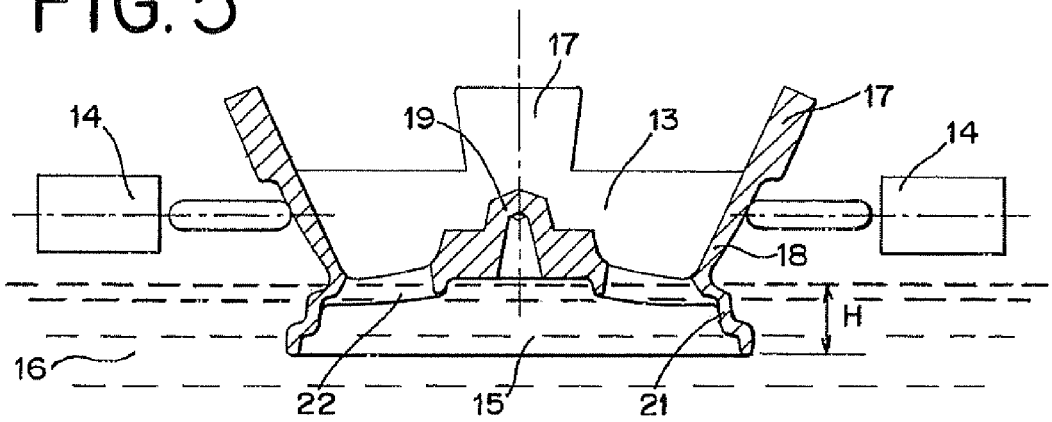
FIG. 5 is a cross-sectional view with schematic illustrations of water cooling prior to flow forming.
Figure 5A:
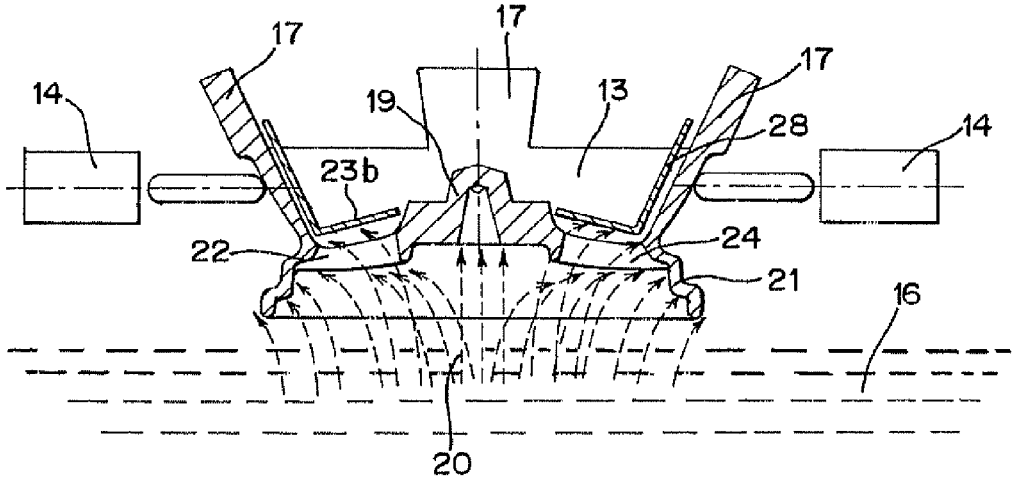
FIG. 5*a* is a schematic illustration in cross-section illustrating cooling of only the front face of a wheel blank that minimizes rim cooling and general heat loss including within the wheel blank itself.

FIGS. 4, 5, 5*a* and 5*b* provide further details regarding the face cooling that typically is carried out after a raw wheel blank is removed from the casting equipment. A raw wheel blank 13 is manipulated by a robot arm 14 so that the face only 15 of the raw wheel blank 13 is immersed in water within a tank 16. This prevents distortion or deformation of the face design of the cast wheel during flow forming. It will be noted that a plurality of raw risers 17 remain on the wheel blank 13, extending from body or rim 18 of the wheel blank. A center riser 19 also is shown. The face 15 includes an outer flange 21 and a design portion 22. The design portion provides the basis for the part of the finished wheel that gives the wheel its unique or aesthetically pleasing appearance. The design portion can vary depending upon the desired wheel design. Typically the depth of the water within the tank 16 is between about 20 mm and 80 mm, depending upon the type of vehicle wheel, including the depth of the outer flange 21. This water depth is indicated at "H" in FIG. 5. Water or other cooling medium 20 typically also is directed upwardly, as illustrated in FIG. 5*a*.

As seen in FIG. 5*a*, raw wheel blank rim or body 18 is the portion of the blank at this stage of the processing that will be subjected to flow-forming by a flow-forming roller as discussed in greater detail herein An insulation cover 23 can be provided as illustrated to retain heat in the wheel during this cooling, including to reduce the chance of cooling water contacting a significant portion of the body or rim 18.

Figure 5B:
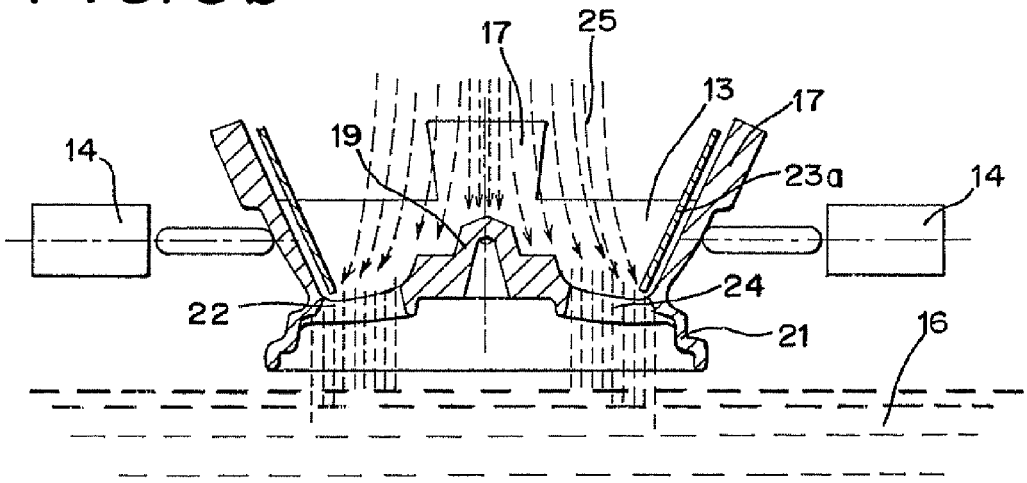
FIG. 5*b* is a schematic illustration in cross-section showing a wheel blank cooling method that minimizes rim cooling and general heat loss during cooling and within the wheel blank itself.

FIG. 5*b* illustrates an embodiment wherein the inside surface 24 of the face 15 also is contacted with a cooling medium, in this case a flowing cooling medium 25. In this embodiment, an insulation cover 23*a* continues to reduce heat loss during this step, including achieving protection of the rim 18 from cooling while permitting cooling of the face portion as discussed herein. If desired, the same insulation cover can be used in both steps, with the portion 23*b* of cover 23 (FIG. 5*a*) being removable or able to move to gain access to the inside surface of the face 15.

Molding enhancements such as these achieve directional solidification toward the riser portion of the cast wheel as illustrated above particularly in FIG. 3*a*. Cooling effects noted above help to control solidification rate of the cast wheel by maintaining the correct temperature of the mold. Heretofore, coarse microstructure defects and shrinkage defects have occurred in the prior art, typically concentrated in the portion nearest the risers or casting in-gates, due largely to slow solidification rate.

Figure 6:
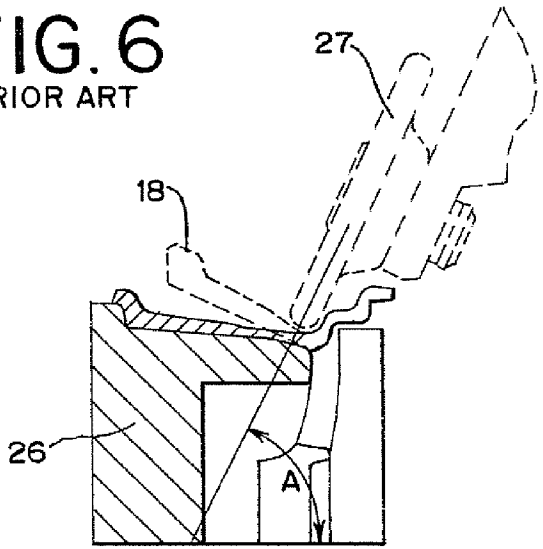
FIG. 6 PRIOR ART
FIG. 6 is a cross-sectional view, with schematic illustrations showing a prior art conventional spinning process during flow forming of a cast aluminum wheel blank.

FIG. 6 provides an example of a prior art conventional flow-forming approach using a flow-forming process. It is generally appreciated that, during casting solidification, coarse microstructure and shrinkage defects are liable to occur in the portion that is near the riser or casting gates, due to a slower solidification rate. While heat treatment typically is carried out to achieve required mechanical properties after casting, they may not be able to eliminate all of the negative effects due to a slow solidification rate, such as coarse primary microstructures. The spinning process modifications described herein effect some refinement of casting microstructure. This flow-forming process includes mounting the raw wheel blank upon a mandrel such as mandrel 26 in FIG. 6, and the raw wheel blank rim 18 is rolled over by a spinning wheel from the outer flange toward the inner flange by a roller 27. The raw rim of the raw wheel blank is deformed gradually, being transformed from the configuration shown in dotted lines in FIG. 6 to the flow-formed configuration shown in solid lines resting on the mandrel 26, as seen in FIG. 6.

Figure 7:
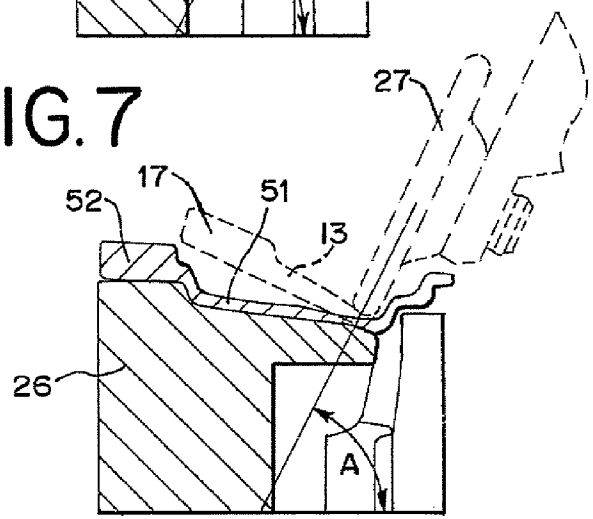
FIG. 7 is a view similar to FIG. 6 but illustrating spinning proceeding in accordance with an embodiment of the present invention with a riser in place.

FIG. 7 shows the approach according to the invention wherein the raw wheel blank 13 includes raw risers 17, as shown in broken lines. After flow forming by operation of the roller 27 in conjunction with the mandrel 26, a flow-formed wheel blank 51 is provided, with risers 52 thereof being fully in tact. The roller 27 is at an inclination angle "A" (FIG. 7), typically of 50 to 80° with respect to the axis of the mandrel. The roller repeatedly feeds along the surface of the blank until the correct flow-formed wheel blank configuration and thickness has been attained (and as programmed into the control mechanism). Often there are 5 to 10 feed cycles in a typical flow-forming sequence for each wheel blank. Maintaining the riser structure at this stage has been found to further enhance microstructure properties as discussed herein.

Figure 8:
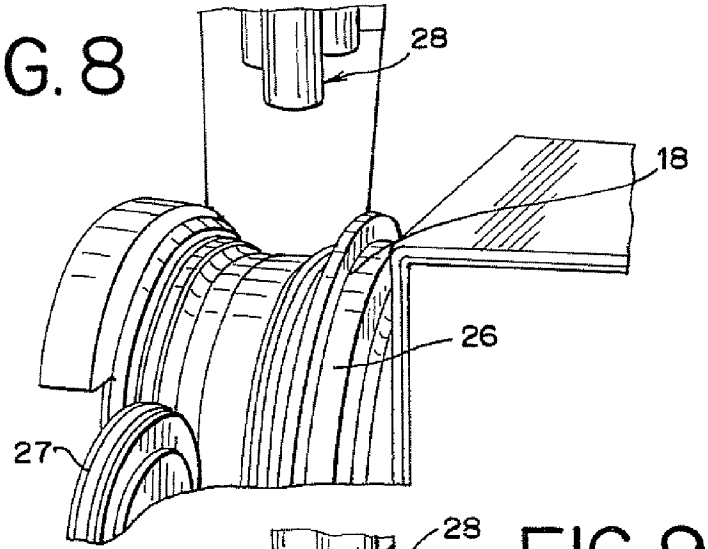
FIG. 8 is a perspective view of the outside surface of a wheel blank during a prior art conventional flow-forming process.

FIG. 8 illustrates the basic approach of flow forming that shows the mandrel 26 rotating the blank while the roller 27 rotates and processes a path over the forming surface of the blank. This FIG. 8 also shows the application of external heat emanating from gas burners 28 and onto the rim area that facilitate flow forming by adding heat to the raw wheel blank in order to assist in forming the flow-formed wheel blank 51. It is the objective that, during spinning, the wheel blank is at a plastic deformation stage.

Figure 9:
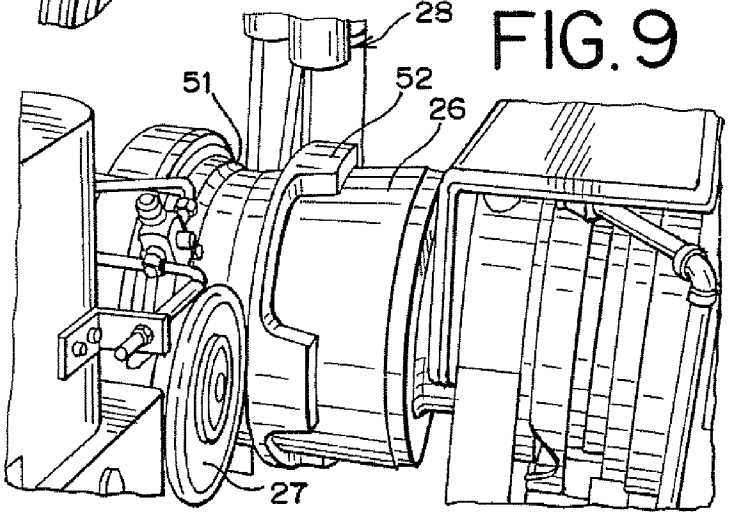
FIG. 9 is a perspective view of the flow-forming process in accordance with an embodiment of the invention and illustrating multiple risers projecting from the wheel blank.

FIG. 9 further shows the flow forming approach in accordance with the present invention. Risers 52 remain on the flow-formed wheel blank 51. It will be noted that the heat from the gas burners 28 can be directed to the risers as shown, which helps to maintain the temperature that is best for flow forming and retain heat in the blank being formed at its plastic deformation stage. Typically, the wheel blank surface temperature is between about 400° C. and 500° C. The objective is to keep the working temperature range at about this level during the flow forming procedure.

The heat sink that is provided by the risers at this stage of the processing means that less heat energy is needed when compared with the prior art approach when the risers are removed prior to flow-forming. All of this helps to control the temperature during flow-forming The melt flow process according to this embodiment requires less time than conventional flow-forming with risers removed, typically reducing flow-forming time due primarily to omission of a preheating step, usually achieving a time reduction of from about 5 to about 8 minutes from the casting and flow-forming operations.

In addition, flow forming according to the invention allows enhanced reduction in wall thicknesses of the flow-formed vehicle wheel blank. Typical rolling reductions average about 38 percent of the rim portion and about 50 percent of the inner flange portion of the flow-formed wheel blank.

FIG. 10 illustrates a raw wheel blank 13 being transported on a one-by-one basis from a casting mold machine 2 and toward a flow forming machine 3 A robot gripper moves the raw wheel blank 13 to place it onto a conveyor 54. As seen in FIG. 11, conveyor 54 has an insulating tunnel 55 to enclose the wheel blank and retain heat within the wheel blank during transport between stations, in this case between the casting station and the flow forming station FIG. 12 illustrates a flow forming station 3. This FIG. 12 shows a spray unit 56 that is spraying mold lubricant onto the surface of the mandrel 26, which is designed to conform to the inner rim profile of the wheel to be formed. In this illustrated embodiment, the spray unit 56 is mounted onto a robot unit 57 that had transported the raw wheel blank from the conveyor 54 to the flow forming station 3. Mounting on the robot unit 57 has the advantage that the spry unit 56 encounters the mandrel only at a time immediately prior to insertion of the raw wheel blank 13 onto the mandrel 26. Otherwise, the spray unit is not in the vicinity of the mandrel and does not interfere with its operation.

FIG. 13 illustrates the robot unit placing the raw wheel blank 13 onto the mandrel 26. This insertion step is carried out immediately after the mold lubrication step illustrated in FIG. 12. In the illustrated embodiment, the robot-mounted spray unit 56 sprays the body of the mandrel 26 while the spray unit simultaneously rotates at a slow speed with respect to the mandrel After such lubrication, the illustrated robot arm swings and mounts the wheel blank on the mandrel, followed by clamping the blank on the tailstock side, as can be seen in FIG. 7.

After flow forming has been completed, the flow-formed wheel blank 51 is moved by a robot unit 58, such as the illustrated take-out and transfer robot, from the flow forming station 3 to the one-by-one solution heat treatment furnace 4, illustrated in greater detail in FIG. 14. It will be noted that each flow-formed wheel blank 51 is independently heated at substantially the same height within the furnace and with adequate spacing therebetween so as to avoid undesirable thermal influences among the wheel blanks. FIG. 14 shows the exit end of the solution treatment furnace 4 for movement to the quench station 5.

With more particular reference to the one-by-one heat treatment process from the flow forming machine, the flow-formed wheel blanks 51 are moved by the robot unit 58 to the solution treatment furnace 4, first being placed in front of the furnace entrance, and then moving through a front gate of the furnace. In the one-by-one type of solution heat treatment furnace 4 that is shown, a rapidly rising temperature zone and equalizing temperature zone are established, and each flow-formed wheel blank 51 is subjected to same. By this approach, temperature gradients are minimized due in large measure to the adoption of the optimizing temperature uniformity system that controls operation of the production line. All of this makes it possible to elevate the temperature in the solution treatment phase up to near the eutectic temperature, thereby achieving better uniformity of metallurgical structure and shorter heat treatment processing time.

In this regard, according to synchronized timing of the control system, when each wheel blank first is delivered into the rapidly rising temperature zone of the furnace 4, it is heated from between about 200° C. to 250° C. up to between about 540° C. and about 550° C. in about 30 minutes. Next, each wheel blank then is transferred into an equalizing temperature zone within the furnace, typically according to control system synchronized timing, taking approximately 60 minutes to pass through this zone which is at a temperature of between about 540° C. and about 550° C. At this stage, it is assured that each wheel blank is at this desired temperature. At suitable timing according to the control system for synchronized the production line, the end door opens, and a transverse-fork type of take out robot moves in to remove a wheel blank from the furnace station 4 and transport same to the quench station 5. At this station, each wheel blank is quenched, typically in water, to produce a supersaturated solution condition.

Figure 16:
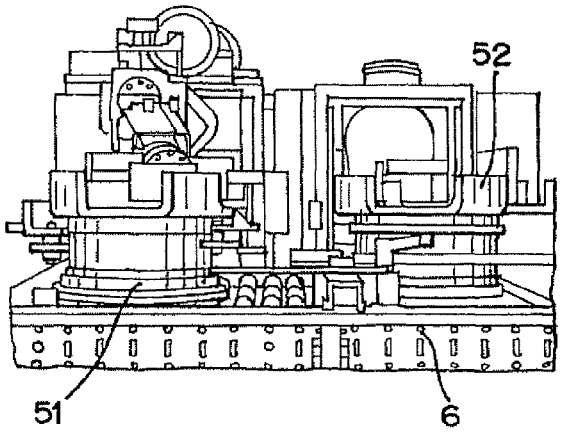
FIG. 16 illustrates a quenched cast wheel with multiple risers still in place while being fed into a riser removal station.
Figure 17:
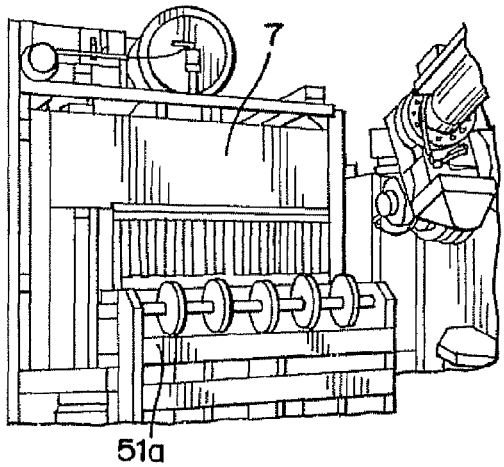
FIG. 17 is an illustration showing one-by-one placement of wheel blanks after riser removal and as entering into a one-by-one aging treatment furnace.

The quenched flow-formed wheel blank 51 then is moved to the riser removal station 6, illustrated in FIG. 16. At this stage, each riser 52 is removed, typically by cutting with two circular rotating cutter blades, in order to provide a wheel blank 51*a* which then is conveyed to the aging furnace 7. Each wheel blank 51*a* remains in the aging furnace for approximately 30 minutes until it equilibrates to the aging furnace temperature of about between 150° C. and about 160° C. The resulting finished wheel blank then is stored or moved directly to a station for machining, polishing or otherwise treating the wheel blank into a finished cast aluminum vehicle wheel for use on automobiles, trucks and the like. These wheels meet safety requirements for vehicles and provide excellent design opportunities coupled with toughness and durability under different road conditions, all in an exceptionally light wheel.

Figure 18:
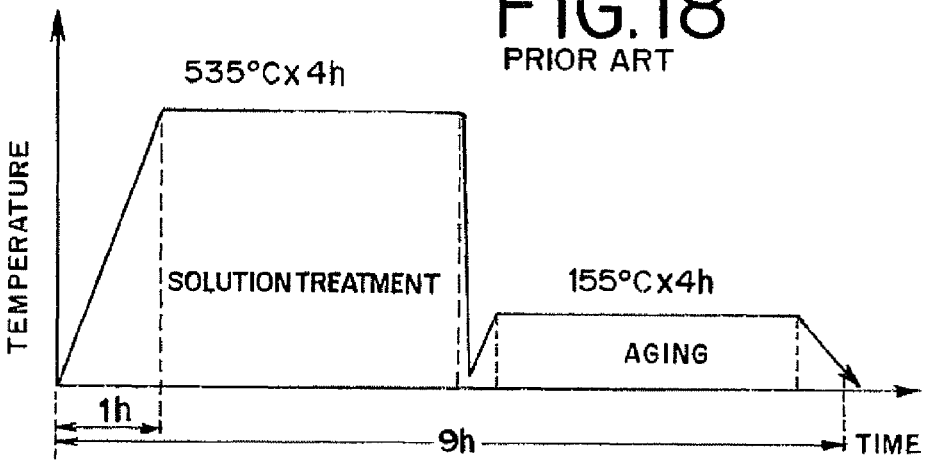
FIG.18 PRIOR ART
FIG. 18 is a flow chart illustrating cycle time for a prior art conventional batch type heat treatment processing approach.
Figure 19:
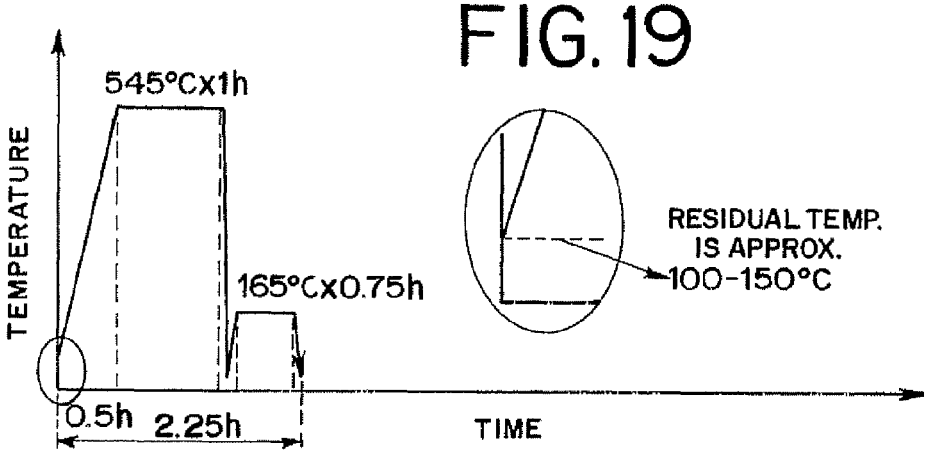
FIGS. 19 is a flow chart of heat treatment cycle time when embodiments of the invention are implemented.

FIG. 18 provides a time line for a conventional batch-type heat treatment furnace. That conventional prior art approach requires approximately 9 hours in order to achieve the heat treatment needed for the flow-formed wheel blanks 51. The solution treatment requires approximately 4 hours, and it typically is not appropriate to proceed with the solution treatment at a maximum temperature for such a long time frame. Typically, the solution treatment is carried out at about 535° C. Because, in the conventional approach, risers have been removed from the blanks well before this stage, the solution treatment furnace of this prior art approach starts at approximately ambient temperature, and approximately one hour is required to reach the 535° C. level. After solution furnace treatment, the batch of blanks are cooled and subjected to aging. With this prior art approach, another four hours is required for aging, and the temperature practiced for this long time (compared to the invention) is approximately 155° C. The net result is a cycle time of nine hours for heat treatment and aging FIG. 19 provides a time line for the solution treatment and aging embodiment of the present invention. Due to handling and maintenance of the risers on the flow-formed wheel blanks 51, each blank has a residual temperature of about 100° C. and about 150° C or above, thereby reducing the heat-up time to about one half hour and of course thereby saving energy. Because of the efficiencies of the one-by-one approach used in the solution heat treatment furnace 4, including using hot-blast riser temperature technology, heat treatment at the temperature is for a much shorter time period (approximately 1 hour) and thus can be somewhat higher, at approximately 545° C. Also, higher temperatures in the furnace 4 are possible because in batch processes the temperature must be kept lower then maximum to prevent overheating of blanks that are at a location in the batch that are exposed to hot spots in the basket or other batching means.

Similarly, the aging step according to the invention requires only a very short time period, approximately 0.75 hour and therefore the temperature can be slightly higher (approximately 165° C.). Thus, the cycle time is only about 2.25 hours. This represents a savings in cycle time of over six hours and a substantial savings in energy due to the significantly reduced times needed for solution furnace treatment and aging that are available with this embodiment of the invention.

Production line processing as discussed herein results in shortening of cycle time during each of the casting process, the flow-forming process and the heat treatment steps. Energy saving effects also are realized due to the reduced time and more efficient use of heat energy, due in part to the one-by-one overall approach of the processing line as well as at the flow forming stations. Cast aluminum wheel products made according to the invention are enhanced in microstructure details and mechanical properties when compared with cast aluminum wheels not made according to the invention. This can be seen by comparison of microstructures, modification in mechanical properties and high density superiority.

Figure 20:
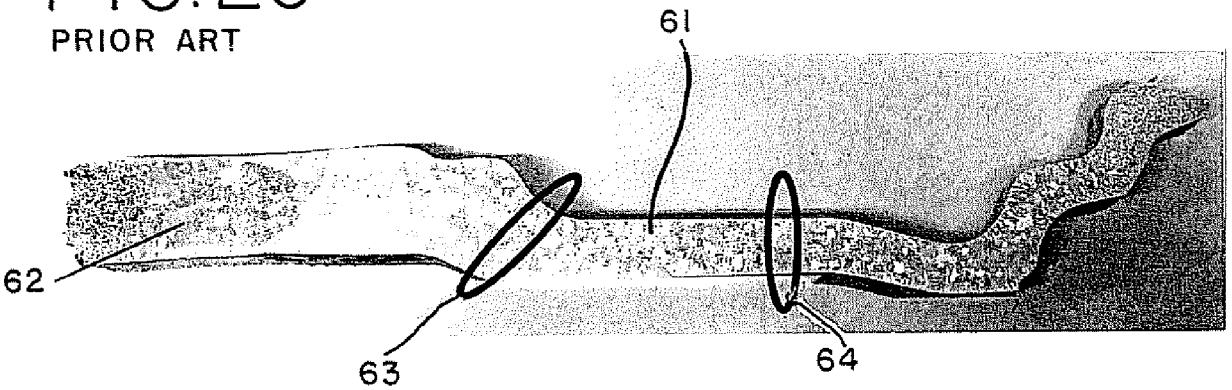
FIG. 20 PRIOR ART
FIG. 20 is a photograph of a cross-section through a cast aluminum wheel manufactured by prior art conventional casting.
Figure 21:
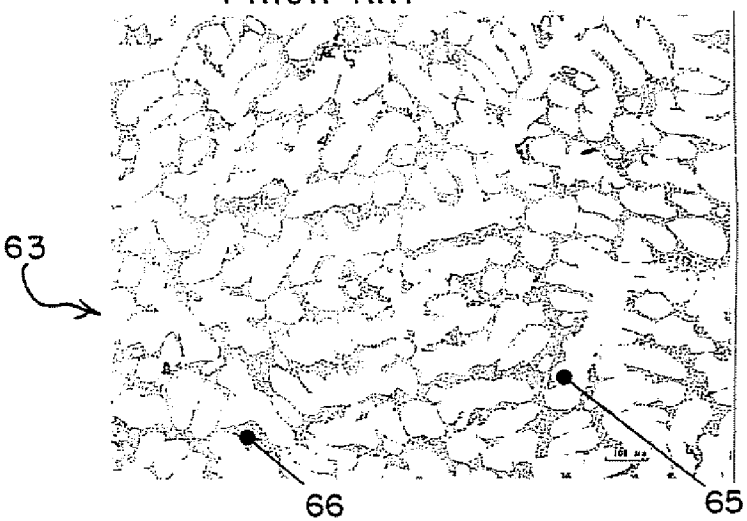
FIG. 21 PRIOR ART
FIG. 21 is a photograph of an enlarged view of a section taken from the casting of FIG. 20.
Figure 22:
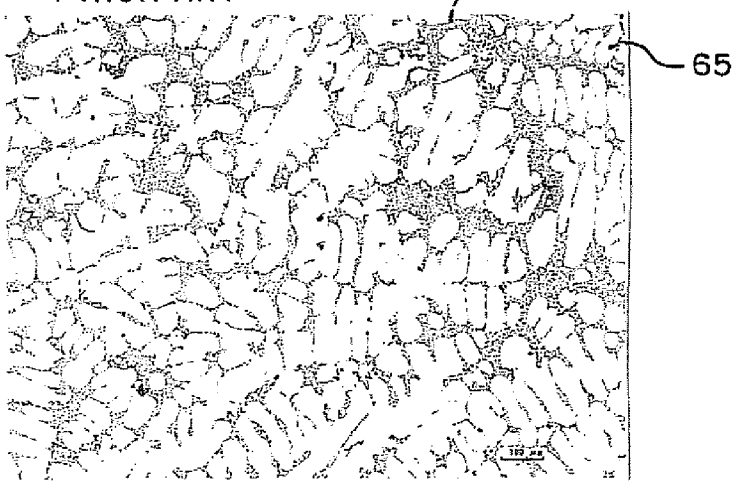
FIG. 22 PRIOR ART
FIG. 22 is a photograph of an enlarged view of another section taken from the casting of FIG. 20.

Improvements brought about by the present invention include providing cast aluminum wheels for vehicles that have enhanced microstructures and enhanced functional and mechanical properties. In this regard, FIG. 20 shows a section through an aluminum wheel manufactured by conventional procedures. For purposes of this illustration, a wheel section 61 made conventionally is shown with a riser 62 remaining for illustrative purposes. Included is an area 63 near the edge of the wheel and another area 64 that is more centrally located. FIG. 21 shows area 63 composed of a primary phase 65 that appears in a lighter coloration, interspersed with a eutectic phase 66 which can be seen in FIG. 21 in a darker grey-scale coloration. FIG. 22 shows the primary phase 65 and eutectic phase 66 at that location of the prior art aluminum wheel. In these instances, the darker coloration indicates lower strength areas.

Figure 23:
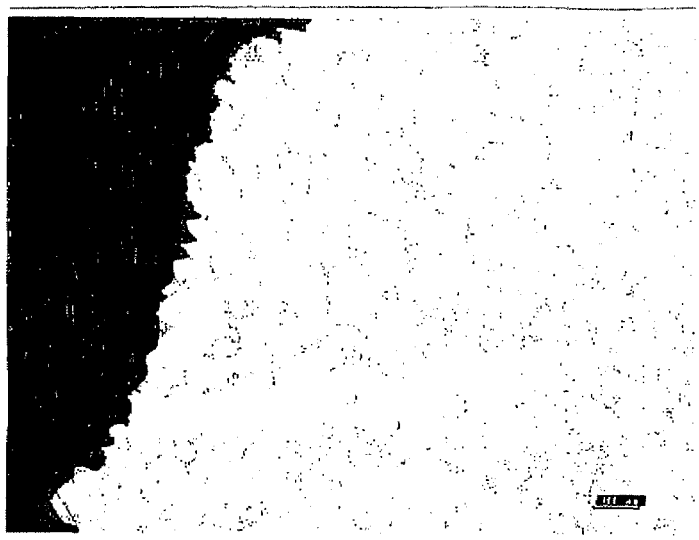
FIG. 23 is photographic reproduction of a cast aluminum wheel manufactured by prior art conventional casting processing illustrating fracture along the eutectic phases when subjected to tension load.

FIG. 23 illustrates an aluminum wheel of the type shown in FIG. 20 that had been subjected to a tension load until breakage. FIG. 23 shows that this prior art approach resulted in the fracture occurring substantially exclusively along the eutectic phases. It generally understood that the eutectic phase is weaker than the primary phase. It is also generally understood that the eutectic phase includes a higher quantity of eutectic particles, impurities, inclusions and miscellaneous metallic compounds, when compared to the primary phase. This illustrates an inherent weakness in the aluminum wheels prepared according to the prior art approaches.

Figure 24:
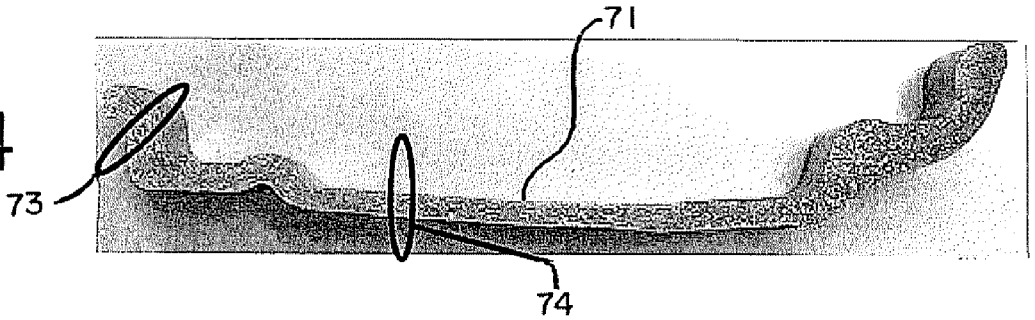
FIG. 24 is a photograph of a sectioned portion of a cast aluminum wheel manufactured according to the present invention.

FIG. 24 is a wheel section 71 of an aluminum wheel manufactured according to the process of the invention as described herein. This includes an area 73 near an edge location, as well as an area 74 that is more centrally located along the wheel.

Figure 25:
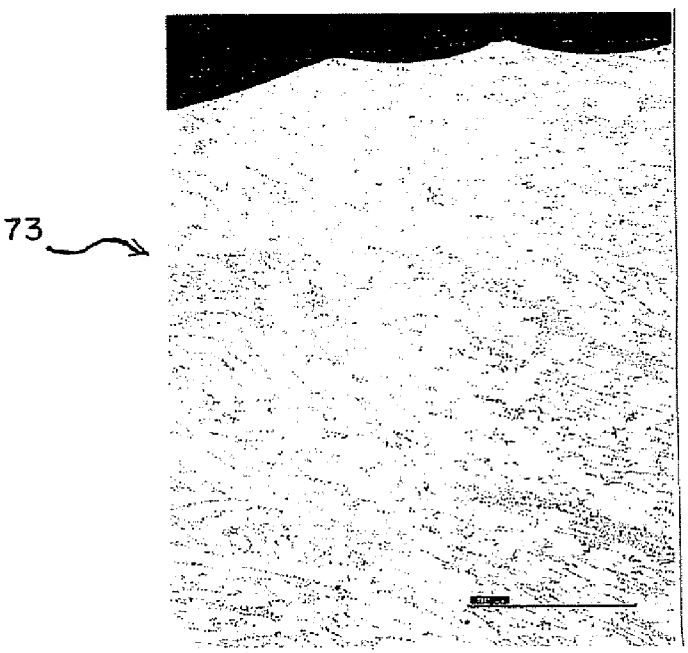
FIG. 25 is a photograph of an enlarged view of a section taken from the casting of FIG. 24.
Figure 26:
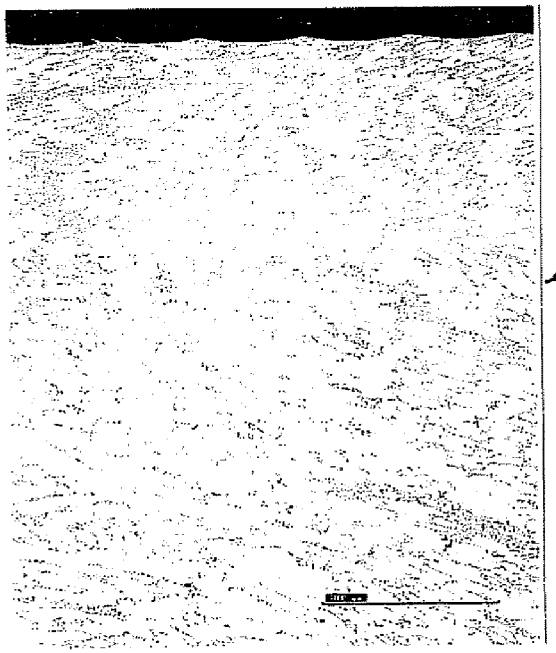
FIG. 26 is a photograph of an enlarged view of another portion of FIG. 24.

Enlargements of these areas, seen in FIG. 25 and FIG. 26, show a less pronounced (compared with FIGS. 21, 22 and 23 of the prior art wheel) delineation between primary phases and eutectic phases. This also is evident from FIG. 24 (compared with FIG. 20 of the prior art wheel).

Figure 27:
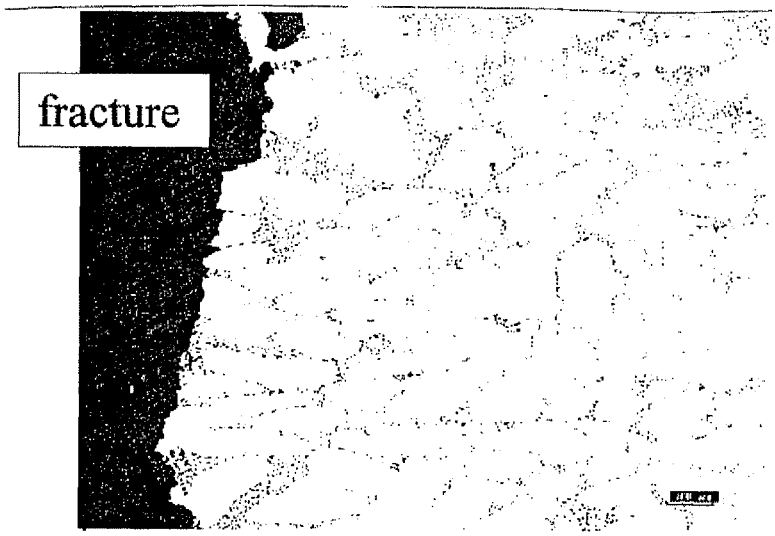
FIG. 27 is a photograph showing the microstructure of an aluminum wheel section manufactured according to the present invention showing that fracture occurred across both eutectic phases and primary phases when subjected to tension load.
Figure 28:
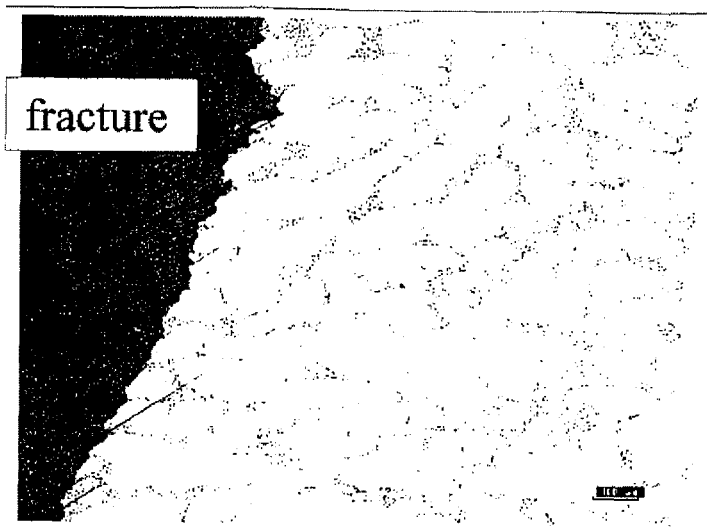
FIG. 28 is a photograph showing the microstructure of another portion of an aluminum wheel section manufactured according to the invention showing fracture across both eutectic and primary phases when subjected to tension load.

FIG. 27 shows a fracture that occurred when area 73 was subjected to a tension load resulting in wheel breakage at this area. It will be noted that the fracture occurred across both primary phases and eutectic phases of the wheel made according to the present invention. Without being bound by any theory, it is presently believed that this enhanced microstructure (when compared with the coarse microstructure of aluminum wheels made according to the prior art gravity die casting process as shown in FIGS. 20, 22 and 23) is the result of the microstructures of both the primary phases and eutectic phases being stretched during the processing according to the invention.

Irrespective of exactly how this improvement is achieved, to illustrate that cast aluminum wheels made in accordance with the present invention are superior to cast aluminum wheels made by prior art approaches that use gravity die casting, FIG. 29 reports upon density measurements at the inner flange of the prior art such as illustrated in FIGS. 20 through 23, with 6 inner flange areas being tested and measured four times each. The average density was 2.6471 grams/cubic centimeter. FIG. 29*a* reports on density testing at the inner flange area of cast aluminum wheels made in accordance with the present invention, the average density being 2.6698 grams/cubic centimeter. This represents a significant increase in density. FIG. 29*a* also shows an average rim density that exceeded the inner flange density of the prior art wheels, namely 2.6725 grams/cubic centimeters.

These density enhancements have the advantage of being able to manufacture cast aluminum wheels that are thinner in their wall thickness dimensions while still maintaining the same strength levels. This results in the ability to manufacture cast aluminum wheels that are lighter in weight, which is an advantage both from an aesthetic perspective and from the perspective of conservation of materials and energy.

FIG. 30 reports upon tensile strength and elongation testing for a prior art conventional cast aluminum wheel, while FIG. 30*a* shows data for a cast aluminum wheel made according to the present invention. In the case of the inner flange, the average tensile strength improvement was from 276 MPa up to 302 MPa. For the rim portion of the respective wheels, the tensile strength improvement was from 280 MPa to 306 MPa. The elongation percentage also was enhanced The average for the inner flange being improved was from 5.4% to 9.7%, and for the rim the improvement was from 6.5% to 14.7% FIGS. 30 and 30*a* additionally report upon proof stress testing, also showing improvement. The inner flange average for the prior art wheel was 213 MPa and for the wheel according to the invention, 229 MPa. At the rim area, the improvement was less, from 218 MPa to 219 MPa.

Figure 31:
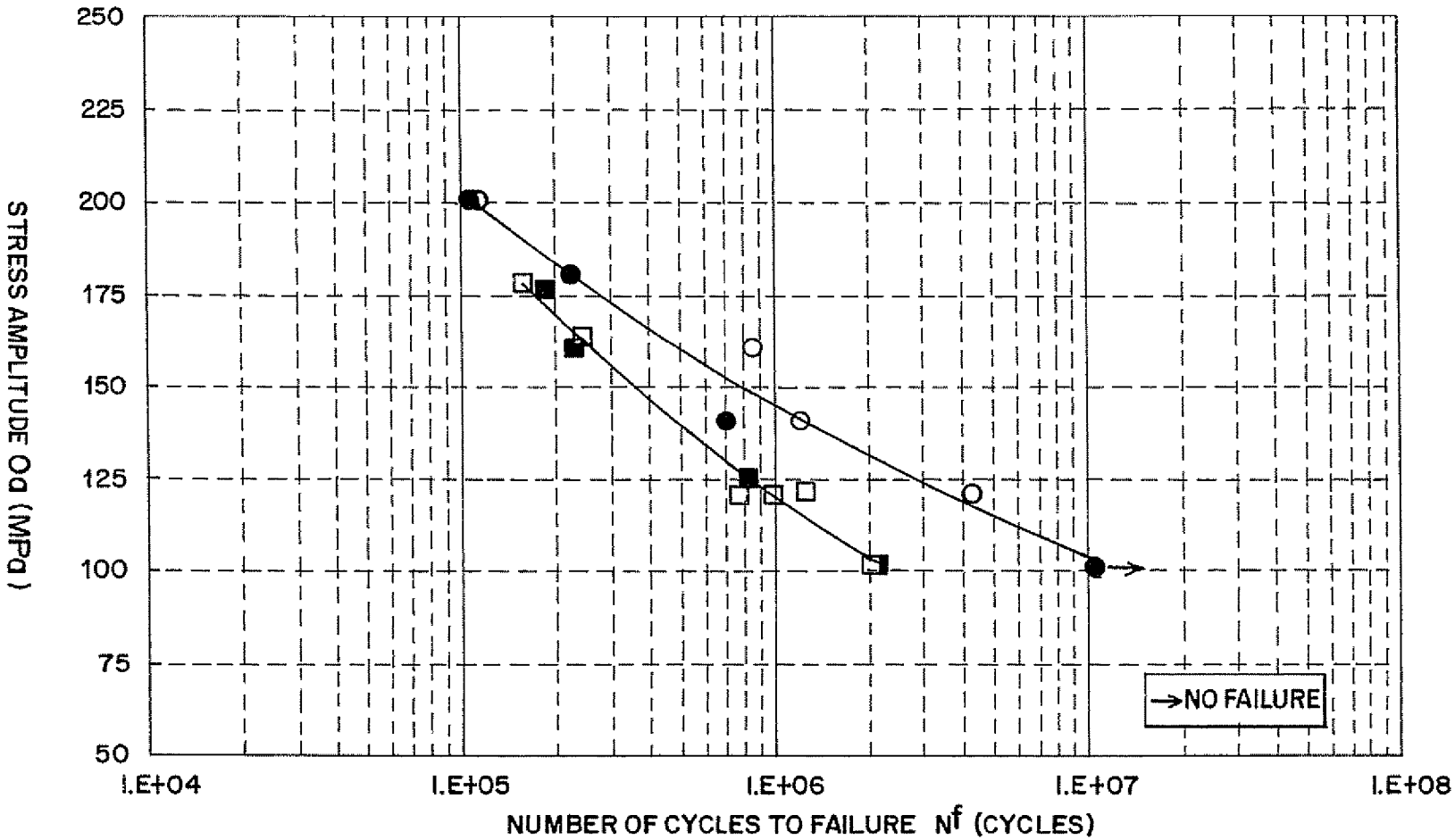
FIG. 31 is a plot of stress amplitude data for prior art conventional cast aluminum wheels and for cast aluminum wheels made according to the invention.

FIG. 31 plots stress amplitude data versus the number of cycles to failure. The open square data points are for the inner rim of a conventional cast aluminum wheel, and the solid square data points are for the inner flange of a conventional cast aluminum wheel. The open circle data points were taken at the inner rim of a cast aluminum wheel made according to the invention, and the solid circle data points were taken at the inner flange of a cast aluminum wheel made according to the present invention. This illustrates a greatly enhanced fatigue stress for the wheels according to the present invention These wheels had a 20% to 30% increase in fatigue strength when compared with conventional cast aluminum wheels. For example, when 100 MPa of stress amplitude was applied to the conventionally cast wheel, cycle failure occurred at one unit beyond 1.E+06 cycles (first dotted vertical line beyond same), while when the same stress amplitude was imparted to the inner flange of the wheels made according to the invention, no failure was observed even after 1.E+07.

Both types of wheels subjected to this testing of FIG. 31 were made of A356 aluminum. The temperature of this testing was at room temperature, the stress frequency was 25 Hertz, and the stress ratio was −1. These enhanced stress properties further illustrate the ability of the wheels of the invention to be made with a reduced wall thickness when compared with a conventional cast aluminum wheel, without sacrificing fatigue strength. For example, the invention renders possible aluminum vehicle wheels having a wall thickness of 4 mm, compared with a typical minimum of 6 mm for the prior art processes Alternatively, significantly enhanced fatigue strength can be provided when exceptionally thick-walled wheels are not chosen.

Other physical properties of products according to the invention that are enhanced when compared with conventional cast aluminum wheels include radial fatigue testing which follows a standard testing procedure to simulate driving a vehicle at cornering speed. Other testing includes impact tests where a one-ton weight is dropped onto the rim of a wheel and the trueness of its circularity is determined. Wheels according to the invention equaled or surpassed prior art wheels in these tests.

It will be understood that the embodiments of the present invention which have been described are illustrative of some of the applications of the principles of the present invention. Numerous modifications may be made by those skilled in the art without departing from the true spirit and scope of the invention, including those combinations of features that are individually disclosed or claimed herein.

The invention claimed is:

1. A process for manufacturing cast aluminum vehicle wheels, comprising:

forming molten aluminum within a casting mold configured, sized and shaped in order to provide a raw cast aluminum wheel blank from the molten aluminum, the blank having a rim and a face;

said forming including utilizing at least one gate associated with the casting mold resulting in the formation of at least one riser extending from the body of the blank;

further processing the cast aluminum wheel blank while the riser remains connected to the blank;

said further processing includes: (a) cooling substantially primarily the face of the wheel blank, (b) heating an outside portion of the wheel blank and flow forming same to provide a flow-formed wheel blank, (c) heat treating the wheel blank, and (d) quenching the thus flow-formed wheel blank; and removing the riser from the flow-formed wheel blank to provide a cast aluminum vehicle wheel.

2. The process according to claim 1, wherein said forming within the casting mold includes directing cooling fluid onto an exposed surface of the casting mold.

3. The process according to claim 1, wherein said (a) cooling includes positioning an insulation cover over the rim of the wheel blank and immersing the wheel into a cooling medium up to a level approximating that of the face of the wheel blank.

4. The process according to claim 1, wherein said (a) cooling includes positioning an insulation cover over the rim of the wheel blank and directing a cooling medium upwardly onto the face of the wheel blank.

5. The process according to claim 1, wherein said (a) cooling includes positioning an insulation cover over the rim of the wheel blank and directing cooling fluid onto a surface of the wheel blank opposite to the face of the wheel blank.

6. The process according to claim 1, wherein said cooling reduces the temperature of the face of the wheel blank from between about 400-500° C. to below approximately 250° C.

7. The process according to claim 1, wherein said further processing handles the cast aluminum wheel blanks in a one-by-one manner and avoids batch processing.

8. The process according to claim 1, wherein said (b) flow forming includes positioning the cast aluminum wheel blank on a rotating mandrel, said positioning being preceded by directing release coating onto the mandrel, said directing being accomplished by a robot unit that delivers the cast aluminum wheel to the mandrel.

9. The process according to claim 8, wherein said directing includes rotating the release coating directing means with respect to the mandrel.

10. The process according to claim 1, wherein said further processing includes conveying the cast aluminum wheel blank along a pathway that includes an insulating cover through which the blank travels.

11. A process for manufacturing cast aluminum vehicle wheels, comprising:

forming molten aluminum within a casting mold configured, sized and shaped in order to provide a raw cast aluminum wheel blank from the molten aluminum, the blank having a rim and a face;

said forming including utilizing at least one gate associated with the casting mold resulting in the formation of at least one riser extending from the body of the blank;

further processing the cast aluminum wheel blank while the riser remains connected to the blank;

said further processing includes: (a) cooling substantially only the face of the raw cast aluminum wheel blank by contacting substantially only the face of the raw wheel blank with a cooling medium in order to reduce the temperature of the face to less than about 250° C. while the remainder of the raw aluminum wheel blank remains above about 400° C., (b) heating an outside portion of the raw wheel blank and flow forming same to provide a flow-formed wheel blank, (c) heat treating the wheel blank, and (d) quenching the thus flow-formed wheel blank; and removing the riser from the flow-formed wheel blank after said quenching to provide a cast aluminum vehicle wheel.

12. The process according to claim 11, wherein said forming within the casting mold includes directing cooling fluid onto an exposed surface of the casting mold.

13. The process according to claim 11, wherein said (a) cooling includes positioning an insulation cover over the rim of the wheel blank and immersing the wheel into a cooling medium up to a level approximating that of the face of the wheel blank while also directing cooling fluid upwardly onto the face of the wheel blank.

14. The process according to claim 13, wherein said (a) cooling further includes directing a cooling medium upwardly onto the face of the wheel blank.

15. The process according to claim 13, wherein said further processing handles the cast aluminum wheel blanks in a one-by-one manner and avoids batch processing.

16. The process according to claim 15, wherein said (b) flow forming includes positioning the cast aluminum wheel blank on a rotating mandrel, said positioning being preceded by directing release coating onto the mandrel, said directing being accomplished by a robot unit that delivers the cast aluminum wheel to the mandrel, said directing including rotating the release coating directing means with respect to the mandrel.

* * * * *